US005501610A

United States Patent [19]

Ikemoto

[11] Patent Number: 5,501,610

[45] Date of Patent: Mar. 26, 1996

[54] FLEXIBLE CABLE CONNECTOR

[75] Inventor: Shinichi Ikemoto, Tokyo, Japan

[73] Assignee: Kel Corporation, Tokyo, Japan

[21] Appl. No.: 301,527

[22] Filed: Sep. 6, 1994

[30] Foreign Application Priority Data

Sep. 7, 1993 [JP] Japan ..... 5-053379 U

[51] Int. Cl.[6] ..... H01R 9/07

[52] U.S. Cl. ..... 439/498; 439/67; 439/260

[58] Field of Search ..... 439/492–493, 439/60, 67, 77, 259, 260, 495, 496, 498

[56] References Cited

U.S. PATENT DOCUMENTS

| | | | |
|---|---|---|---|
| 4,684,183 | 8/1987 | Kinoshita et al. | 439/77 |
| 4,969,840 | 11/1990 | Ii et al. | 439/495 |
| 5,106,311 | 4/1992 | Yodogawa et al. | 439/77 |
| 5,276,817 | 1/1994 | Matschke et al. | 395/275 |
| 5,370,552 | 12/1994 | Chishima et al. | 439/495 |

FOREIGN PATENT DOCUMENTS

| | | | |
|---|---|---|---|
| 0239422 | 9/1987 | European Pat. Off. | 439/496 |
| 0274609 | 7/1988 | European Pat. Off. | 439/492 |
| 0544184 | 6/1993 | European Pat. Off. | 439/492 |
| 2642607 | 8/1990 | France | 439/60 |
| 3266384 | 11/1991 | Japan . | |
| 434880 | 2/1992 | Japan . | |
| 5101859 | 4/1993 | Japan . | |

*Primary Examiner*—David L. Pirlot
*Assistant Examiner*—Jill DeMello
*Attorney, Agent, or Firm*—Robert W. J. Usher

[57] ABSTRACT

A flexible cable connector has an insulating housing with cable receiving cavities opening at respective mouths to respective opposite faces of the housing. Rows of electrical contacts are mounted in respective cavities and first and second, cable clamping sliders are latched by locking arms on opposite ends thereof to respective opposite ends of the housing with central cable pressing portions entering respective mouths. The locking arms on the same slider are offset to extend in different levels or planes so that the arms can move past each other along the end of the housing in a cable insertion direction from a cable admitting to a cable clamping position without interfering with each other.

6 Claims, 6 Drawing Sheets

FLEXIBLE CABLE CONNECTOR

FIELD OF THE INVENTION

The invention relates to a flexible cable connector for connecting end portions of flexible cables, flexible circuitry etc to each other.

BACKGROUND OF THE INVENTION

Japanese Public Disclosure Bulletin No 5-101859 published Apr. 23, 1993 discloses a flexible cable connector comprising: an elongate insulating housing having first and second, oppositely directed, cable receiving faces and formed with first and second, elongate cable receiving cavities with respective cable receiving mouths opening to the respective cable receiving faces; electrical contacts mounted in rows extending along respective cable receiving cavities; first and second, elongate, cable clamping sliders each having a central pressing portion, actuating portions at respective opposite ends of the pressing portion and locking arms with latching means at free ends thereof extending from respective actuating portions thereof in an insertion direction; means provided on opposite longitudinal ends of the housing for mounting the first and second cable clamping sliders on the housing with the respective locking arms extending towards opposite faces and respective pressing portions extending along the first and second cable receiving faces in alignment with respective cable receiving gaps for reciprocal sliding movement in the insertion direction between open, cable admitting positions in which the respective pressing portions are adjacent the respective cable admitting mouths to permit end portions of respective flexible cables to be inserted therethrough past the respective pressing portions into the respective cavities and closed, cable clamping positions in which the pressing portions are advanced into respective first and second cavities pressing respective conductive paths of inserted cable end portions into engagement with respective contacts to effect electrical connection therewith.

In the above-described connector, as the locking arms must retain the cable clamping sliders assembled with the housing in both cable admitting and cable clamping positions, the effective inter-face dimension of the housing in the direction of sliding movement of the locking arms (insertion direction) is relatively large to prevent the locking arms from interfering with each other during travel to the cable clamping position which results in a connector of undesirably large overall size.

SUMMARY OF THE INVENTION

An object of the invention is to provide a connector of the above-disclosed type in which the inter-face dimensions are reduced while avoiding interference between the locking arms.

According to the invention, at each end of the connector, the locking arms extending from the first face are offset from locking arms extending from the second face so that they are located at different levels and their latching means can be moved past each other with their respective locking arms extending in side by side relation to latch the respective cable clamping sliders in the cable clamping position.

This construction enables the inter-face dimension of the housing to be less than the sum of the effective lengths of the locking arms thereby providing a desirable reduction in the overall size of the connector.

Preferably, the locking arms of the same cable clamping slider are offset to extend at different levels from each other.

This enables both cable clamping sliders to be of identical shape and merely inverted for use on opposite faces, affording a desirable reduction in the number of parts required for manufacture inventory and assembly with consequentially advantages in costs in high volume mass production.

BRIEF DESCRIPTION OF THE DRAWINGS

A specific embodiment of a flexible cable connector according to the invention will now be described by way of example only and with reference to the accompanying drawing in which.

DESCRIPTION OF THE PREFERRED EMBODIMENT

Figure 1:
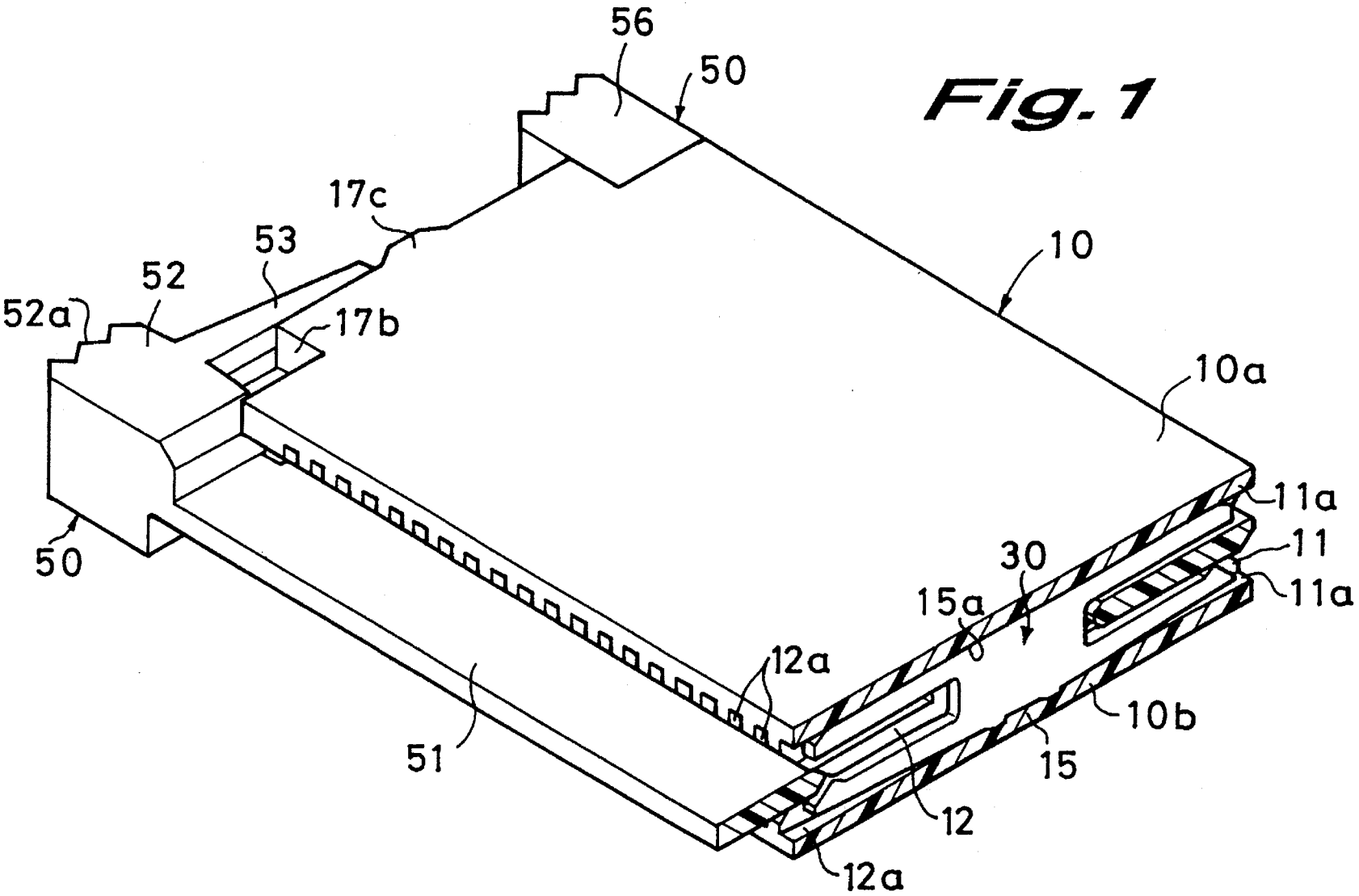
FIG. 1 is a perspective view, partly cut away of the connector.

As shown in FIG. 1, the connector consists of an elongate housing 10 molded in one piece of insulating plastic; a series of contacts 30, each stamped and formed from a single piece of sheet metal stock and mounted in a row along the insulating housing 10; and a pair of identical cable pressing sliders 50, assembled with the insulating housing 10 for reciprocal sliding movement along an insertion axis between cable admitting and cable clamping positions.

Figure 2:
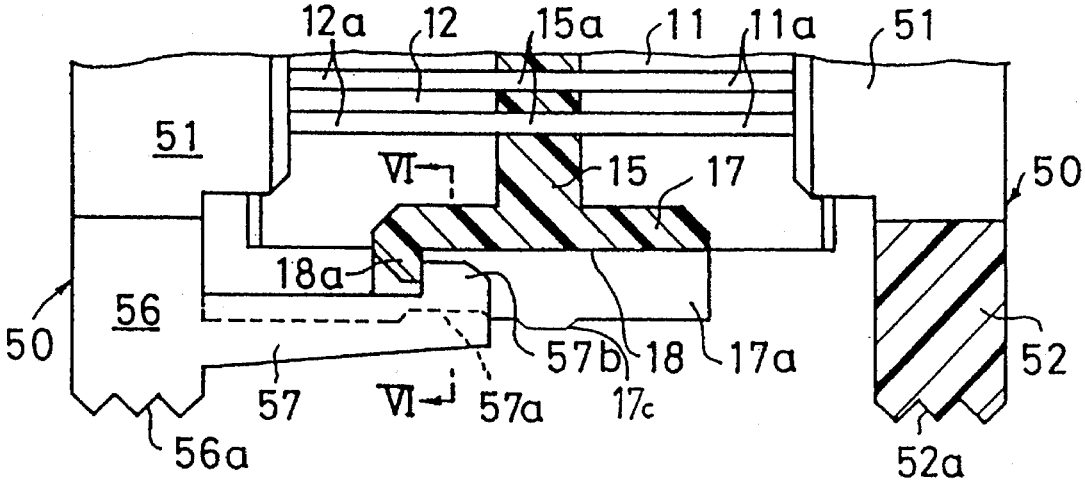
FIG. 2 is a fragmentary plan view of the connector, partly in cross-section.
Figure 3:
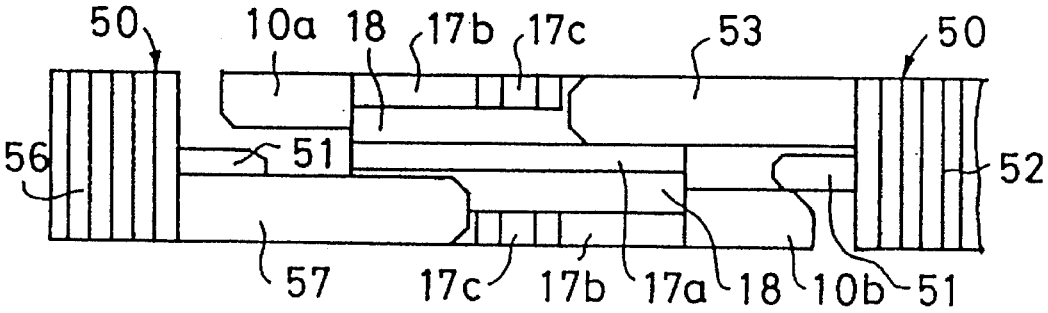
FIG. 3 is an end elevation of the connector.
Figure 4:
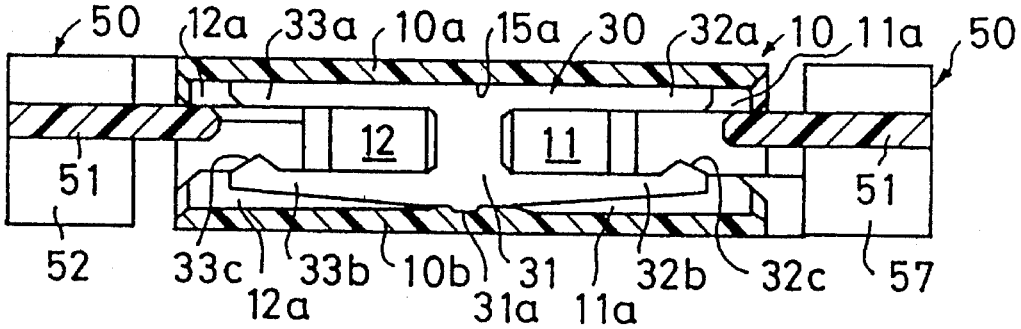
FIG. 4 is a side elevation of the connector, partly in cross-section.

As shown more clearly in FIGS. 2–4, the insulating housing 10 is substantially rectangular in plan, formed by substantially parallel, upper and lower sidewalls, **10*a* and 10*b*, respectively, which are joined by a longitudinally extending central wall 15 forming a generally I-shape cross section and defining first and second, longitudinally extending cable receiving cavities 11 and 12, respectively, on respective opposite sides of the central wall 15. The cavities open to opposite, first and second, oppositely directed (front and rear) cable receiving faces at respective cable admitting mouths. Rows of upper and lower, aligned, contact guiding and locating grooves 11*a* and 12*a*, respectively, are formed in the inner surfaces of the upper and lower sidewalls, forming the walls of respective cable receiving cavities, each groove extending in an insertion direction between a respective cable admitting mouth and the central wall 15 in communication with opposite sides of a corresponding row of contact anchoring through-sockets 15***a* formed through the central wall 15 between both cable receiving cavities.

Opposite longitudinal ends of the central wall 15 are formed with transverse end walls 17 which join the upper and lower sidewalls and extend in the insertion direction. A central guide wall 17*a*, and upper and lower guide walls 17*b* are formed on the outer surface of each end wall 17 to extend longitudinally outward therefrom in the insertion direction and in parallel, spaced apart relation with the upper and lower guide walls being of less longitudinal outward dimension than the central guide wall so that the upper and lower guide walls 17 define with the central wall two guiding grooves 18, also extending in the insertion direction. Overridable slider positioning projections 17*c* having ramp surfaces are formed at substantially central locations of respective upper and lower guide walls 17*b* while slider retaining, stop projections 18*a* are formed on respective entry ends of respective grooves 18 for latching the respective sliders in open and closed positions, respectively.

Each contact 30 is a one-piece metal stamping of I configuration and comprises a central, plate-like body or anchoring portion 31 from respective opposite (upper and lower) ends of front and rear edge portions of which, extend first and second pairs of upper and lower arm portions 32*a* and 32*b*, and 33*a* and 33*b*, respectively. In each pair, the arm portions extend in substantially parallel, coplanar relation and at a predetermined separation, providing a cable-receiving gap of predetermined width with the cable-receiving gaps of the same contact opening in opposite directions. Contact protuberances 32*c* and 33*c* are formed on a free (front) end of respective lower arm portions 32*b* and 33*b* of each pair and project toward a respective upper arm portion 32*a* and 33*a*. Small, anchoring teeth 31*a* which project downward are formed on a bottom edge of the central portion 31.

The contacts 30 are assembled with the housing by forcible insertion or stitching through a cable admitting mouth so that respective upper and lower arm portions 32*a*, 32*b* and 33*a*, 33*b* respectively, are received in respective upper and lower grooves 11*a* and 12*a* and the respective body portions 31 are received as interference or press fits in respective anchoring sockets 15*a* with the teeth 31*a* biting into the bottom walls of the sockets, anchoring the contacts in position. The upper and lower arm portions 32*a*, 32*b* and 33*a*, 33*b* of the first and second pairs, respectively extend along upper and lower sidewalls and are located in respective first and second cable receiving cavities 11 and 12, respectively, and open towards the respective cable admitting mouths.

Figure 5:
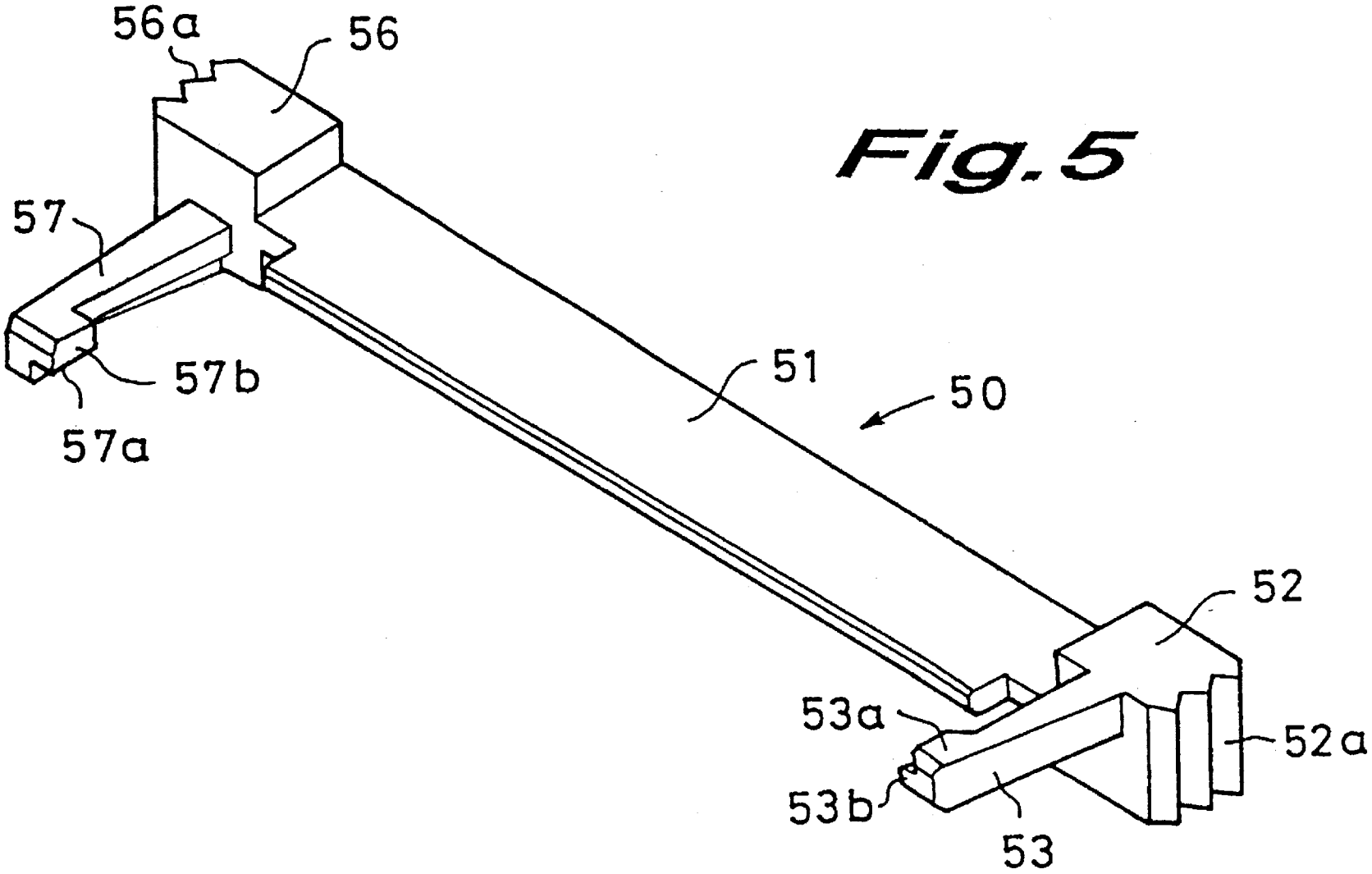
FIG. 5 is a perspective view of a cable clamping slider of the connector.

As shown in FIG. 5, the slider 50, is molded in one piece from insulating plastic with an elongate, plate-shape, central pressing portion 51 of predetermined length and width in the insertion direction, finger engageable actuating portions 52 and 56 at respective opposite ends thereof, from upper and lower portions of which extend upper and lower locking arms 53 and 57, respectively.

Figure 6:
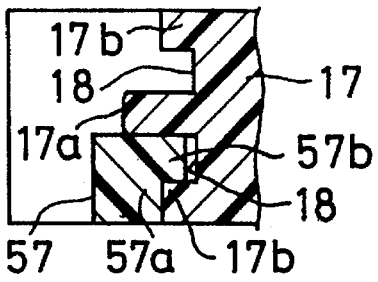
FIG. 6 is a cross sectional view of the connector taken along line VI—VI of FIG. 2.
Figure 7:
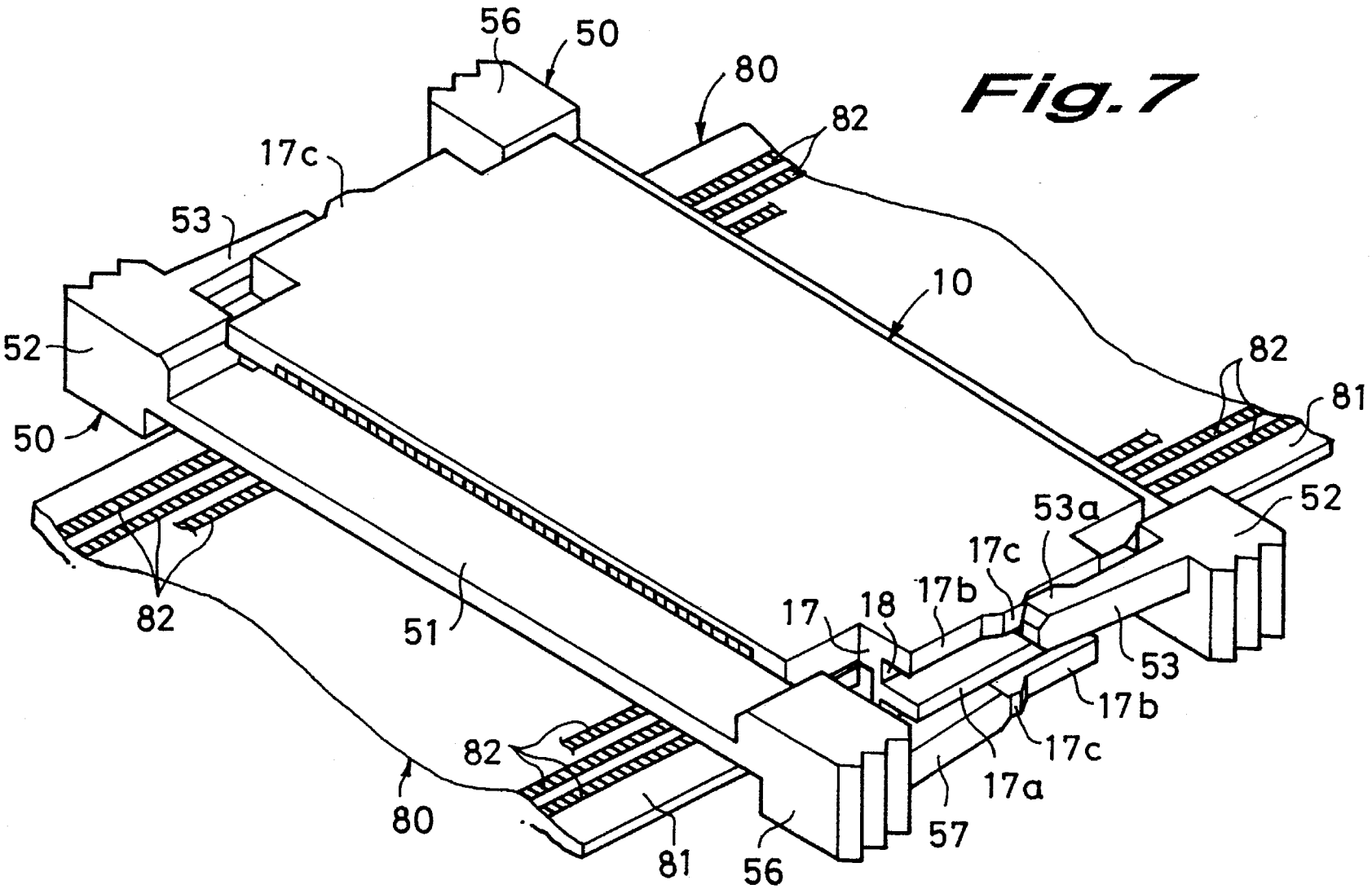
FIG. 7 is a perspective view of the connector in the cable admitting position receiving a flexible cable for connection thereto.

First latching projections 53*a*, 57*a* and second latching projections 53*b* and 57*b*, are formed on respective opposed inner faces of free ends of the locking arms and protrude inwardly towards each other in the longitudinal direction of the housing 10. The first projections 53*a*, 57*a* are of less height than the second projections 53*b* and 57*b* and have tapered surfaces. Portions of the arms extending between the first projections 53*a*, 57*a* and the actuating portions are rebated. Notched finger engageable surfaces 52*a* and 56*a* are formed on respective outer faces of the actuating portions 52 and 56, respectively The cable clamping sliders 50 are assembled with the insulating housing 10 with the leading edges of their pressing portions 51 inserted in the cable admitting mouths of respective cable receiving cavities and with the upper and lower locking arms 53 and 57, respectively, extending in opposite senses along outer surfaces of the opposite end walls 17 so that, as shown for example in FIG. 6, the first latching projections 53*a*, 57*a* rest on the outer, top surfaces of the upper and lower guide walls 17*b* and the second latching projections 53*b* and 57*b* are received in respective guiding grooves 18. This enables manual reciprocal sliding movement of the respective cable pressing sliders between a withdrawn, cable admitting position, shown in FIGS. 2 and 7, in which a latching shoulder on the second latching projection 57*b* engages the stop projection 18*a*, preventing removal from the groove and an advanced, cable clamping position, shown in FIG. 9, in which the first projections 53*a*, 57*a* have ridden over the positioning projections 17*c*.

Figure 8:
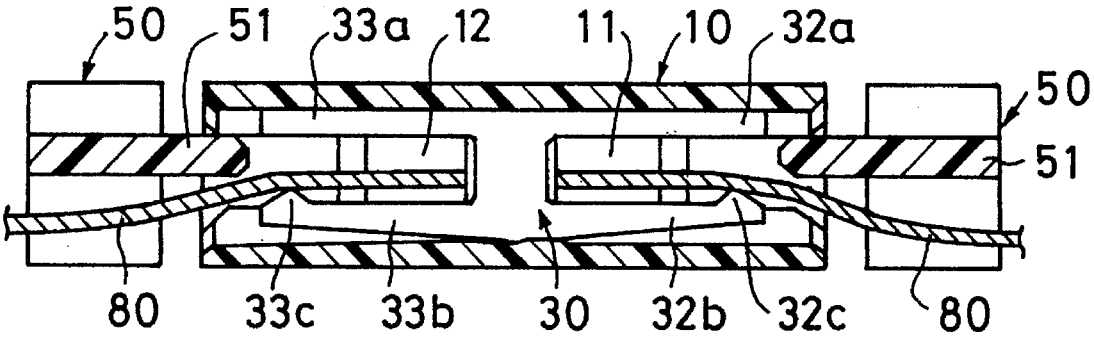
FIG. 8 is a cross sectional view of the connector in the cable admitting position.
Figure 10:
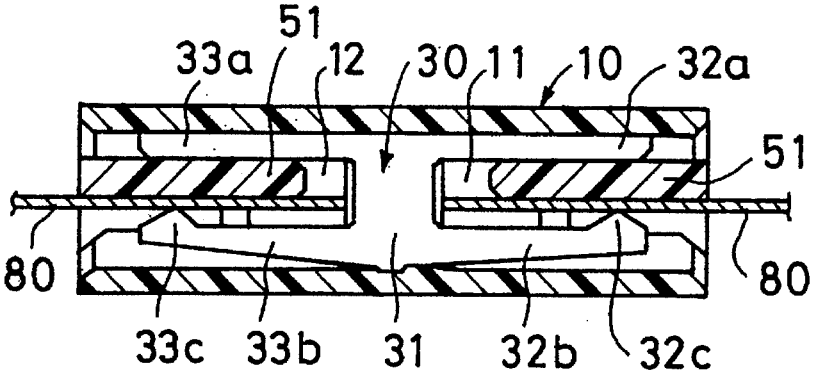
Figure 9:
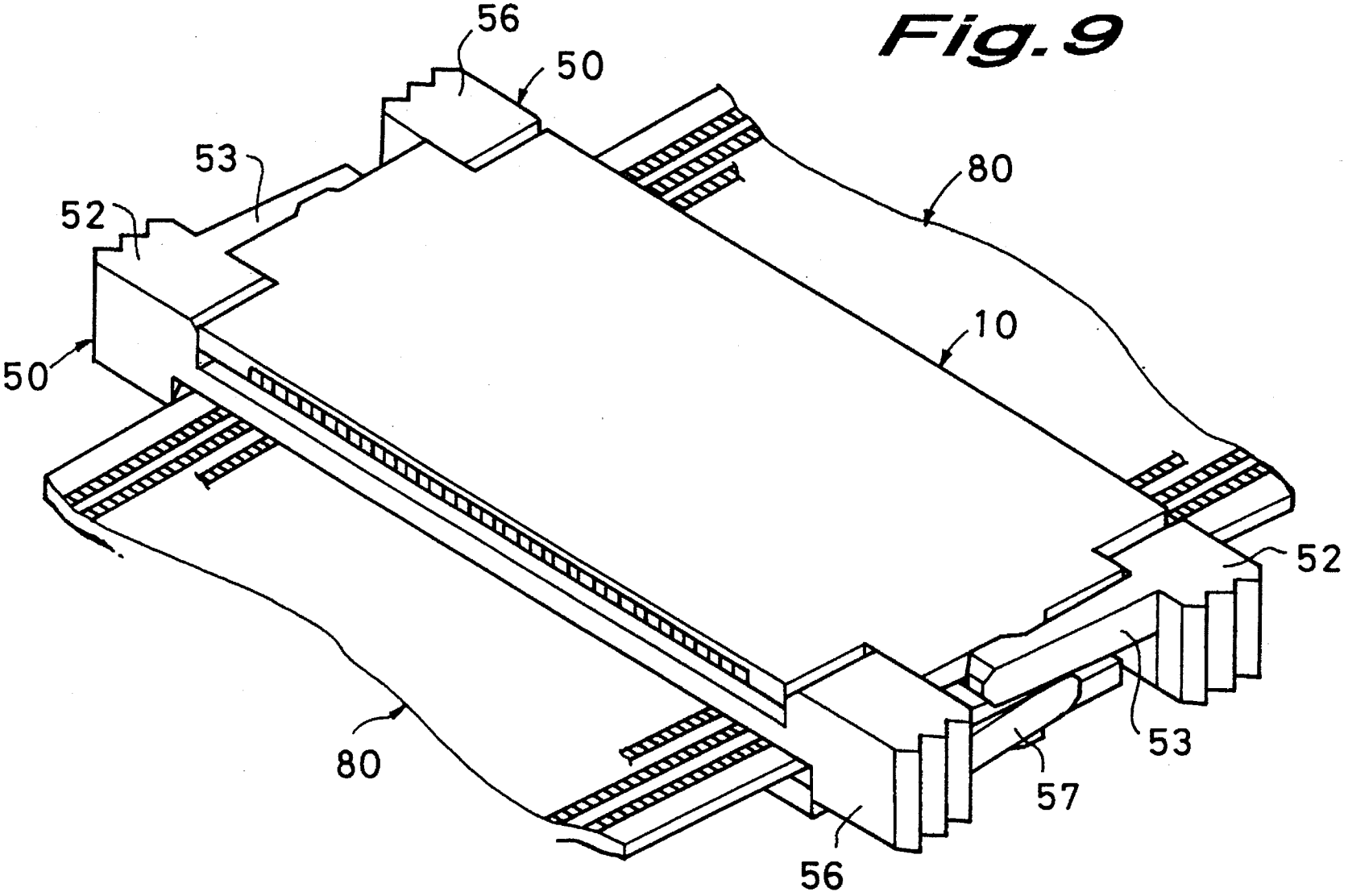
FIG. 9 is a perspective view of the connector in the cable clamping position establishing electrical connection to a flexible cable; and, FIG. 10 is a cross sectional view of the connector in the cable clamping position.

In the withdrawn, cable admitting position, the leading edge portions of the pressure plate portions are located in the respective mouths of respective cable receiving cavities 11 and 12, as shown in FIG. 8, enabling respective flexible cables 80 to be inserted past the respective cable pressing portions 51 into respective cable receiving cavities 11 and 12. The actuating portions 52 and 56 are then gripped between the fingers and pushed in the insertion direction until the pressing portions are fully inserted into respective cable receiving cavities 11 and 12, as shown in FIGS. 9 and 10, when they force the conductive paths or wiring pattern 82 of the cable against the respective contact teeth 32*c* and 33*c* to establish reliable electrical connection with respective contacts 30, and the locking arms 53 and 57 resiliently flex to permit projections 53*a*, 57*a* thereon to ride over the protuberances to assist in maintaining the cable clamping sliders in the inserted position.

As the locking arms 53 and 57 are vertically offset, they can move freely past each other or overlap, in side by side relation without interference. This enables the dimension of the housing in the insertion direction to be minimized, reducing the overall size of the connector.

The placement of the respective locking arms of the same slider at upper and lower levels enables sliders for both first and second cable receiving cavities to be identical, (and one of a pair simply inverted for use in the same connector), requiring the manufacture and storage of only a single part instead of two different parts which would be required if the locking arms were placed at the same level.

I claim:

1. A flexible cable connector for effecting electrical connection to respective conductive paths on respective end portions of first and second flexible cables comprising:

an elongate insulating housing having first and second, oppositely directed, cable receiving faces and formed with first and second, elongate cable receiving cavities with respective cable receiving mouths opening to the respective cable receiving faces and aligned with each other in substantially coplanar relation, and with a row of contact receiving sockets extending along the housing between the cable receiving cavities so that each socket communicates with both cable receiving cavities;

a plurality of electrical contacts each having a mounting portion and first and second pairs of arms extending from respective opposite sides thereof, the arms of each pair extending in side by side relation, spaced a predetermined distance apart to provide between them a cable receiving gap, cable receiving gaps provided by first pairs of arms being aligned in substantially coplanar relation with cable receiving gaps provided by respective corresponding second pairs of arms and at least one arm of each pair of arms being formed adjacent a free end thereof with a protuberance protruding towards a respective other arm portion of that pair, the contacts being mounted in the housing a row by receipt of respective mounting portions in respective contact receiving sockets and respective arms of the first and second pairs extending adjacent respective opposite sides of the first and second cable receiving cavities, respectively, and with respective cable receiving gaps opening in a cable insertion direction towards respective cable receiving mouths and with at least the protuberances of each contact protruding into the respective cavities adjacent the respective mouths;

first and second, elongate cable clamping sliders each having a central pressing portion, actuating portions, at respective opposite ends of the pressing portion and locking arms extending from respective actuating portions thereof in the insertion direction and having latching means at free ends thereof;

means provided on opposite longitudinal ends of the housing for mounting the first and second cable clamping sliders on the housing with the respective locking arms extending across each longitudinal end of the housing towards opposite faces and respective pressing portions extending along the first and second cable receiving faces aligned in substantially coplanar relation with each other and in alignment with respective cable receiving gaps for reciprocal sliding movement in the insertion direction between open, cable admitting positions, in which the respective pressing portions are adjacent the respective cable admitting mouths and withdrawn from respective cable receiving gaps to permit end portions of respective flexible cables to be inserted through respective cable admitting mouths past the respective pressing portions into the respective cavities and into respective gaps between the first and second pairs of contact arms, respectively, and closed, cable clamping positions in which the pressing portions are advanced into respective first and second cavities and into the gaps pressing respective conductive paths of inserted cable end portions into engagement with respective protuberances to effect electrical connection therewith, at each end of the connector the locking arms extending from the first face being offset from locking arms extending from the second face so that they are located at different levels and their latching means can be moved past each other with their respective locking arms in overlapping relation to latch the respective cable clamping sliders in the cable clamping position by movement of the cable clamping sliders from the cable admitting position to the cable clamping position.

2. A flexible cable connector according to claim 1 wherein the cable clamping sliders are of substantially identical construction, in both cable clamping sliders the locking arms at respective opposite ends of an individual cable clamping slider being offset to extend at different levels from each other.

3. A flexible cable connector according to claim 1 wherein the cable clamping sliders are of substantially identical construction, in both cable clamping sliders the locking arms at respective opposite ends of an individual cable clamping slider being offset to extend at different levels from each other.

4. A flexible cable connector according to claim 3 wherein the mounting means comprises a central guide wall and upper and lower guide walls formed on an outer surface of each end of the housing extending longitudinally outward therefrom in the insertion direction and in parallel, spaced apart relation with the upper and lower guide walls being of less longitudinal outward dimension than the central guide wall so that the upper and lower guide walls define with the central wall two guiding grooves also extending in the insertion direction, slider positioning projections being formed on respective upper and lower guide walls and slider retaining, stop projections formed on respective entry ends of respective grooves, and the respective protuberences comprise first latching projections and second latching projections on respective opposed inner faces of free ends of the locking arms and protruding inwardly towards each other in a longitudinal direction of the housing, the first latching projections being of less height than the second latching projections and the first latching projections being mounted for sliding movement along the upper and lower guide walls and the second latching projections being mounted for sliding movement along the respective grooves for latching the respective sliders in open and closed positions, respectively.

5. A flexible cable connector for effecting electrical connection to respective conductive paths on respective and portions of first and second flexible cables comprising:

an elongate insulating housing having first and second, oppositely directed, cable receiving faces and formed with first and second, elongate cable receiving cavities with respective cable receiving mouths opening to the respective cable receiving faces and aligned with each other in substantially coplanar relation;

electrical contacts mounted in rows extending along respective cable receiving cavities;

first and second, elongate, cable clamping sliders each having a central pressing portion, actuating portions at respective opposite ends of the pressing portion and locking arms with latching means at free ends thereof extending from respective actuating portions thereof in an insertion direction;

means provided on opposite longitudinal ends of the housing for mounting the first and second cable clamping sliders on the housing with the respective locking arms extending across each longitudinal end of the housing towards opposite faces and respective pressing portions extending aligned in substantially coplanar relation with each other along the first and second cable receiving faces in alignment with respective cable receiving mouths for reciprocal sliding movement in the insertion direction between open, cable admitting positions in which the respective pressing portions are adjacent the respective cable admitting mouths to permit end portions of respective flexible cables to be inserted therethrough past the respective pressing portions into the respective cable receiving cavities and closed, cable clamping positions in which the pressing portions are advanced aligned in substantially coplanar relation with each other into respective first and second cable receiving cavities pressing respective conductive paths of inserted cable end portions into engagement with respective contacts to effect electrical connection therewith, at each end of the connector the locking arms extending from the first face being laterally offset from locking arms extending from the second face so that they are located at different levels and their latching means can be moved past each other with their respective locking arms in overlapping relation to latch the respective cable clamping sliders in the cable clamping position by movement of the cable clamping sliders from the cable admitting position to the cable clamping position.

6. A flexible cable connector for effecting electrical connection to respective conductive paths on respective end portions of first and second flexible cables comprising:

an elongate insulating housing having first and second, oppositely directed, cable receiving faces and formed with first and second, elongate cable receiving cavities with respective cable receiving mouths opening to the respective cable receiving faces and with a row of contact receiving sockets extending along the housing between the cable receiving cavities so that each socket communicates with both cable receiving cavities;

a plurality of electrical contacts each having a mounting portion and first and second pairs of arms extending from respective opposite sides thereof, the arms of each pair extending in side by side relation, spaced a predetermined distance apart to provide between them a cable receiving gap and at least one arm of each pair of arms being formed adjacent a free end thereof with a protuberance protruding towards a respective other arm portion of that pair, the contacts being mounted in the housing in a row by receipt of respective mounting portions in respective contact receiving sockets and respective arms of the first and second pairs extending adjacent respective opposite sides of the first and second cable receiving cavities, respectively, and with respective cable receiving gaps opening in a cable insertion direction towards respective cable receiving mouths and with at least the protuberances of each contact protruding into the respective cavities adjacent the respective mouths;

first and second, elongate cable clamping sliders each having a central pressing portion, actuating portions at respective opposite ends of the pressing portion and locking arms extending from respective actuating portions thereof in the insertion direction and having latching means at free ends thereof, the locking arms at respective opposite ends of a cable clamping slider being offset to extend at different levels from each other;

means provided on opposite longitudinal ends of the housing for mounting the first and second cable clamping sliders on the housing with the respective locking arms extending towards opposite faces and respective pressing portions extending along the first and second cable receiving faces in alignment with respective cable receiving gaps for reciprocal sliding movement in the insertion direction between open, cable admitting positions, in which the respective pressing portions are adjacent the respective cable admitting mouths and withdrawn from respective cable receiving gaps to permit end portions of respective flexible cables to be inserted through respective cable admitting mouths past the respective pressing portions into the respective cavities and into respective gaps between the first and second pairs of contact arms, respectively, and closed, cable clamping positions in which the pressing portions are advanced into respective first and second cavities and into the gaps pressing respective conductive paths of inserted cable end portions into engagement with respective protuberances to effect electrical connection therewith, at each end of the connector the locking arms extending from the first face being offset from locking arms extending from the second face so that they are located at different levels and their latching means can be moved past each other with their respective locking arms in overlapping relation to latch the respective cable clamping sliders in the cable clamping position by movement of the cable clamping sliders from the cable admitting position to the cable clamping position;

the mounting means comprising a central guide wall and upper and lower guide walls formed on an outer surface of each end of the housing extending longitudinally outward therefrom in the insertion direction and in parallel, spaced apart relation with the upper and lower guide walls being of less longitudinal outward dimension than the central guide wall so that the upper and lower guide walls define with the central wall two guiding grooves also extending in the insertion direction, slider positioning projections being formed on respective upper and lower guide walls and slider retaining, stop projections formed on respective entry ends of respective grooves, and the respective protuberences comprising first latching projections and second latching projections on respective opposed inner faces of free ends of the locking arms and protruding inwardly towards each other in a longitudinal direction of the housing, the first latching projections being of less height than the second latching projections and the first latching projections being mounted for sliding movement along the upper and lower guide walls and the second latching projections being mounted for sliding movement along the respective grooves for latching the respective sliders in open and closed positions, respectively.

* * * * *